US010377153B2

(12) United States Patent
Arredondo et al.

(10) Patent No.: US 10,377,153 B2
(45) Date of Patent: Aug. 13, 2019

(54) VACUUM SYSTEM CALIBRATION

(71) Applicant: Hewlett-Packard Development Company, L.P., Houston, TX (US)

(72) Inventors: Alberto Arredondo, Les Franqueses del Valles (ES); Eduardo Martin, Sabadell (ES); Ricardo Sanchis, Masquefa (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/749,412

(22) PCT Filed: Oct. 15, 2015

(86) PCT No.: PCT/EP2015/073933
§ 371 (c)(1),
(2) Date: Jan. 31, 2018

(87) PCT Pub. No.: WO2017/063709
PCT Pub. Date: Apr. 20, 2017

(65) Prior Publication Data
US 2018/0215175 A1 Aug. 2, 2018

(51) Int. Cl.
*B65H 5/22* (2006.01)
*B41J 11/00* (2006.01)
*B65H 7/02* (2006.01)

(52) U.S. Cl.
CPC ..... *B41J 11/0085* (2013.01); *B65H 5/224* (2013.01); *B65H 7/02* (2013.01); *B65H 2511/15* (2013.01); *B65H 2515/342* (2013.01); *B65H 2515/83* (2013.01); *B65H 2557/61* (2013.01)

(58) Field of Classification Search
CPC ..... B65H 2406/366; B65H 2406/3662; B65H 2515/83; B65H 2557/61; B65H 2515/34; B65H 2515/342
See application file for complete search history.

(56) References Cited

U.S. PATENT DOCUMENTS

| | | | |
|---|---|---|---|
| 5,048,813 | A | 9/1991 | Wierszewski et al. |
| 6,264,319 | B1 | 7/2001 | Altfather et al. |
| 6,266,494 | B1 | 7/2001 | Budnik et al. |

(Continued)

FOREIGN PATENT DOCUMENTS

| | | |
|---|---|---|
| JP | 2010221462 | 10/2010 |
| JP | 2011020424 | 2/2011 |
| WO | WO-2012024125 | 2/2012 |

OTHER PUBLICATIONS

"Adjusting Vacuum Pressure," 2012: 3 pages, https://www.google.co.in/url?sa=t&rct=j&q=&esrc=s&source=web&cd=2&cad=rja&uact=8&ved=0CCYQFjABahUKEwivqlvDz4THAhVUjo4KHcGgD_Q&url=https%3A%2F%2Fdgs.oce.com%2FPrinterSupport%2FObsolete_Products%2FCS74xx_Customer%2FDocumentation%2FAdjusting%2520Vacuum%2520Pressure.doc&ei=ewW7Ve_-CtScugTBwb6gDw&usg=AFQjCNHkplEOQC0YLAT6k3DEV5OJ8YTK0w&sig2=h9BpcRQchqMpTGqEUoaelQ.

*Primary Examiner* — Jeremy R Severson
(74) *Attorney, Agent, or Firm* — HP Inc. Patent Department

(57) ABSTRACT

A method and apparatus for calibrating a vacuum system in a printing device comprising obtaining a reference pressure value for a print zone of the printing device, measuring a calibration pressure value in the print zone of the printing device when the printing device is at an operating location and the vacuum system is in operation, determining an altitude based on the reference pressure value and the (Continued)

calibration pressure value and applying an operating setting to the vacuum system based on the determined altitude.

20 Claims, 4 Drawing Sheets

(56) References Cited

U.S. PATENT DOCUMENTS

| | | | | |
|---|---|---|---|---|
| 6,621,990 | B1 * | 9/2003 | Beehler | B41J 29/377 347/6 |
| 6,763,201 | B1 | 7/2004 | Reijnders | |
| 6,905,198 | B2 | 6/2005 | Studer et al. | |
| 7,391,982 | B2 | 6/2008 | Ahl et al. | |
| 7,641,185 | B2 * | 1/2010 | Lyons | B65H 3/0808 271/107 |
| 9,283,789 | B2 * | 3/2016 | Ueda | B41J 13/08 |
| 2012/0013668 | A1 | 1/2012 | Martinez-Guillen et al. | |

* cited by examiner

VACUUM SYSTEM CALIBRATION

CROSS-REFERENCE TO RELATED APPLICATION

Pursuant to 35 U.S.C. § 371, this application is a United States National Stage Application of International Patent Application No. PCT/EP2015/073933, filed on Oct. 15, 2015, the contents of which are incorporated by reference as if set forth in their entirety herein.

BACKGROUND

Subsystems within printing devices can have a dependency on atmospheric pressure. Some examples of these subsystems include: print head pressurisation, drying systems, aerosol removal and vacuum systems.

BRIEF INTRODUCTION OF THE DRAWINGS

Examples of the disclosure are further described hereinafter with reference to the accompanying drawings, in which.

DETAILED DESCRIPTION

Figure 1:
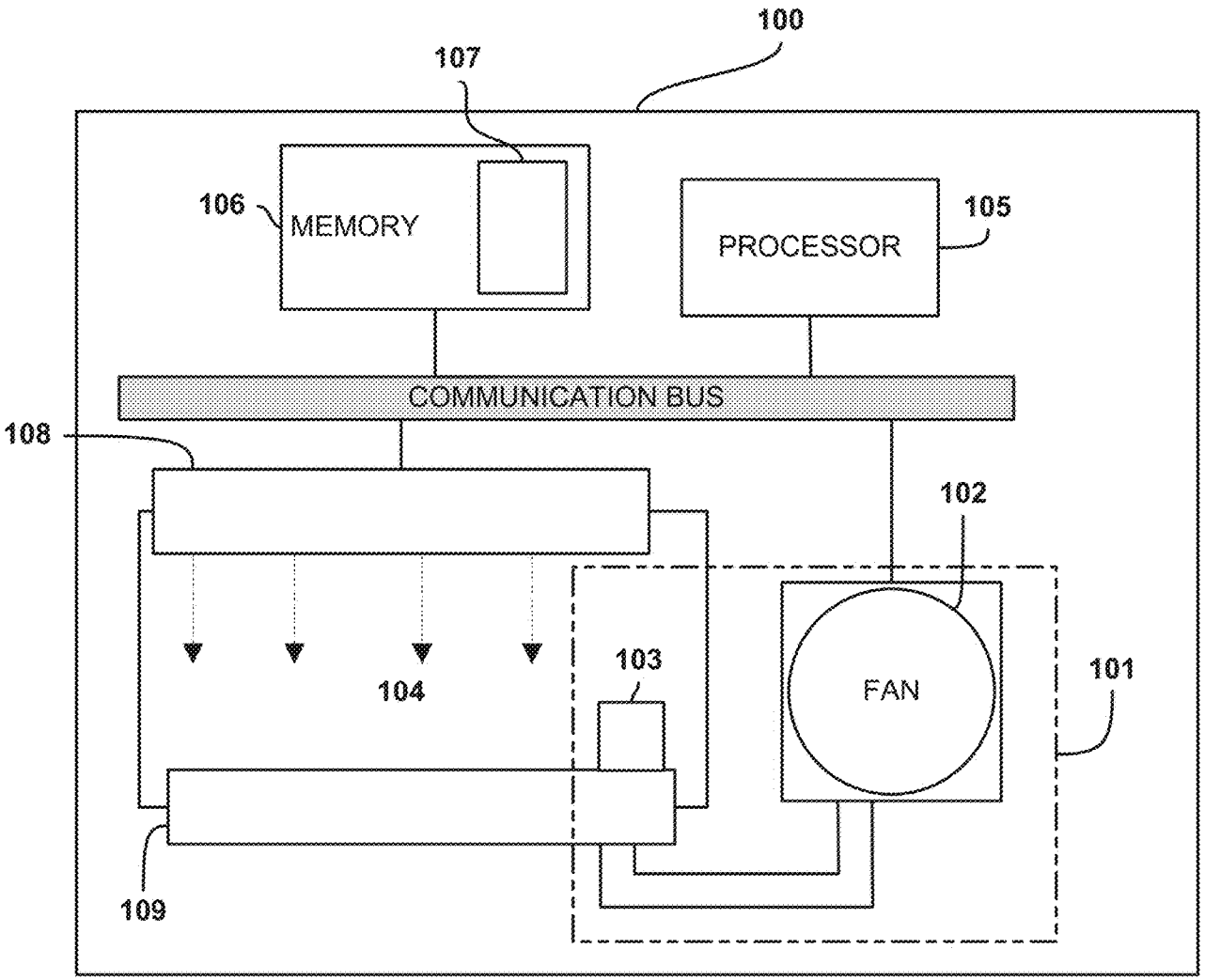
FIG. 1 shows a schematic diagram of one example apparatus for use in a printing device that includes a vacuum system.

As altitude increases, atmospheric pressure decreases, therefore, printer subsystems that may be dependent on atmospheric pressure may not work as effectively or as designed at all operating locations which may be at different altitudes. For example, it is possible for the pressure level to decrease by up to 30% at high altitude locations which may have a significant impact on the subsystems mentioned above as well as other printing device subsystems.

Printing devices may contain one or more subsystems that operate differently with changes in atmospheric pressure and hence operate differently at locations having different altitudes. In some cases, it may be useful to know the altitude that the printing device is operating at so that the one or more subsystems can be adjusted accordingly.

According to one approach, the altitude that the printing device is operating at is entered in by a user during installation. Printing devices where the altitude is entered in by a user often have an adjustment accuracy of approximately 1000 m. This adjustment accuracy can give rise to an error in the actual pressure of up to 10%.

According to some described examples, a value for the reference pressure in a print zone of the printing device is determined at a reference location, for example, during manufacturing and a value for the calibration pressure is measured in the print zone of the printing device at an operating location whilst the vacuum system is in operation. The values for reference pressure and the calibration pressure may then be used to determine an altitude where the printing device is operating. This can eliminate the need for input from the user which may reduce the possibility of human error during installation.

Once the operating altitude is determined, it may be used to calibrate one or more subsystems of the printing device that are dependent on atmospheric pressure, for example, a vacuum system.

An apparatus for use in a printing device is disclosed and comprises a vacuum system, a processor and a memory. The vacuum system comprises at least one vacuum fan and a vacuum sensor. Also disclosed is a method for calibrating the vacuum system in the printing device. According to an example, after the printing device is initialized at the location where it will be operating, it may undergo installation including the calibration of the vacuum system.

According to some examples, to perform the calibration, the vacuum system is set to operate in a precalibrated state. For example, operating the vacuum system in the precalibrated state can include operating the vacuum system using a set of predetermined operational settings. The predetermined operational settings can include a particular speed of rotation of the vacuum fan, a particular geometry of the vacuum fan, a particular number and/or setting of a release opening, a release valve, a chamber and/or a combination of any of the above described predetermined operational settings. The predetermined operational settings may be selected so as to achieve a particular pressure value at a particular altitude. For example, the particular altitude may be sea level and the particular pressure may be a desired operating pressure at sea level. The vacuum sensor in the vacuum system then measures a calibration pressure in a print zone of the printing device whilst the vacuum system is operating in the precalibrated state and the value for the calibration pressure is stored in a memory of the apparatus. The memory also stores program code which, when executed on the processor, performs the task of retrieving a value for a reference pressure and the value for the calibration pressure from the memory. The operating altitude may then be determined based on the values for the reference pressure and calibration pressure. The vacuum system may then be recalibrated to compensate for the change in altitude.

With reference to FIG. 1, an apparatus 100 for use in calibrating the vacuum system of a printing device is disclosed. The example apparatus 100 can include a vacuum system 101, a vacuum fan 102, a vacuum sensor 103, a processor 105, a memory 106 and/or a calibration module 107 within the memory 106. The print zone 104 is the region in the printer where the ink/toner can be transferred from the print engine to the printing medium to generate a printed image. In some example implementations, the print zone is the region disposed between the print engine 108 and the vacuum manifold 109.

As illustrated, example vacuum system 101 comprises the vacuum fan 102 and the vacuum sensor 103. The vacuum fan 102 may be located outside the print zone 104 and coupled to the vacuum manifold 109, for example, by a chamber. In some examples, the vacuum manifold 109 includes a support surface which supports the print medium. The support surface can include vacuum ports through which the vacuum pressure is applied by the vacuum system to the print medium in the print zone. In some examples, the vacuum pressure may be to pull the print medium towards the support surface in order that the print medium may be secured to the support surface and/or away from the ink/toner supply. In some examples, the print medium is pulled away from the ink/tonner supply to avoid smudging and/or smearing, such as fluting, of the ink/tonner. The vacuum sensor 103 may be situated in the print zone 104 and is arranged to measure a pressure in the print zone. The memory 106 is coupled to the processor 105 and the vacuum sensor 103 and may include a calibration module 107. The processor is coupled to the vacuum system 101 to enable the control of the vacuum system by the processor, for example, controlling the activation of the vacuum sensor and controlling the rotation speed of the vacuum fan 102. A communication bus can enable communication between devices in the apparatus 100.

In operation, a vacuum system 101 is initially set to operate in a precalibrated state. As mentioned above, the precalibrated state can include operating the vacuum system using a set of predetermined operational settings. The predetermined operational settings can include a particular speed of rotation of the vacuum fan, a particular geometry of the vacuum fan, a particular number and/or setting of a release opening, a release valve, a chamber and/or a combination of any of the above described predetermined operational settings. These predetermined operational settings can achieve a particular pressure value at a particular altitude. The vacuum sensor 103 can measure vacuum pressure delivered by the vacuum manifold in the print zone 104. The measured vacuum pressure while the vacuum systems is set to operate in the precalibrated state and the printing device is at an operating location is referred to herein as the "calibration pressure". A measurement of reference pressure, stored in the memory, is then retrieved and an operating altitude can be determined based on the values for the reference pressure and the calibration pressure. The determined altitude can then be used to calibrate the vacuum system 101 accordingly.

In some examples, the printing device is an Ink Jet printer. The print zone 104 of the Ink Jet printer is the space where the ink travels from the print head 108 to the print media. The print medium lies on a porous belt; an endless loop secured between a pair of rollers wherein said rollers drive the belt to transport the print medium. A vacuum system 101 is used to apply vacuum pressure to one side of a belt through vacuum ports in a support surface 109 to secure the print medium to it. The vacuum pressure supplied to secure the print medium to the belt may be reduced when the printer is at an altitude higher than the altitude of its manufacture, which may result in the print medium not being adequately secured to the belt and may reduce the quality of the print. Thus, in an Ink Jet printer the vacuum system 101 may be recalibrated to produce a suitable vacuum to hold the print medium against the belt in the printing device at said operating altitude.

Figure 2:
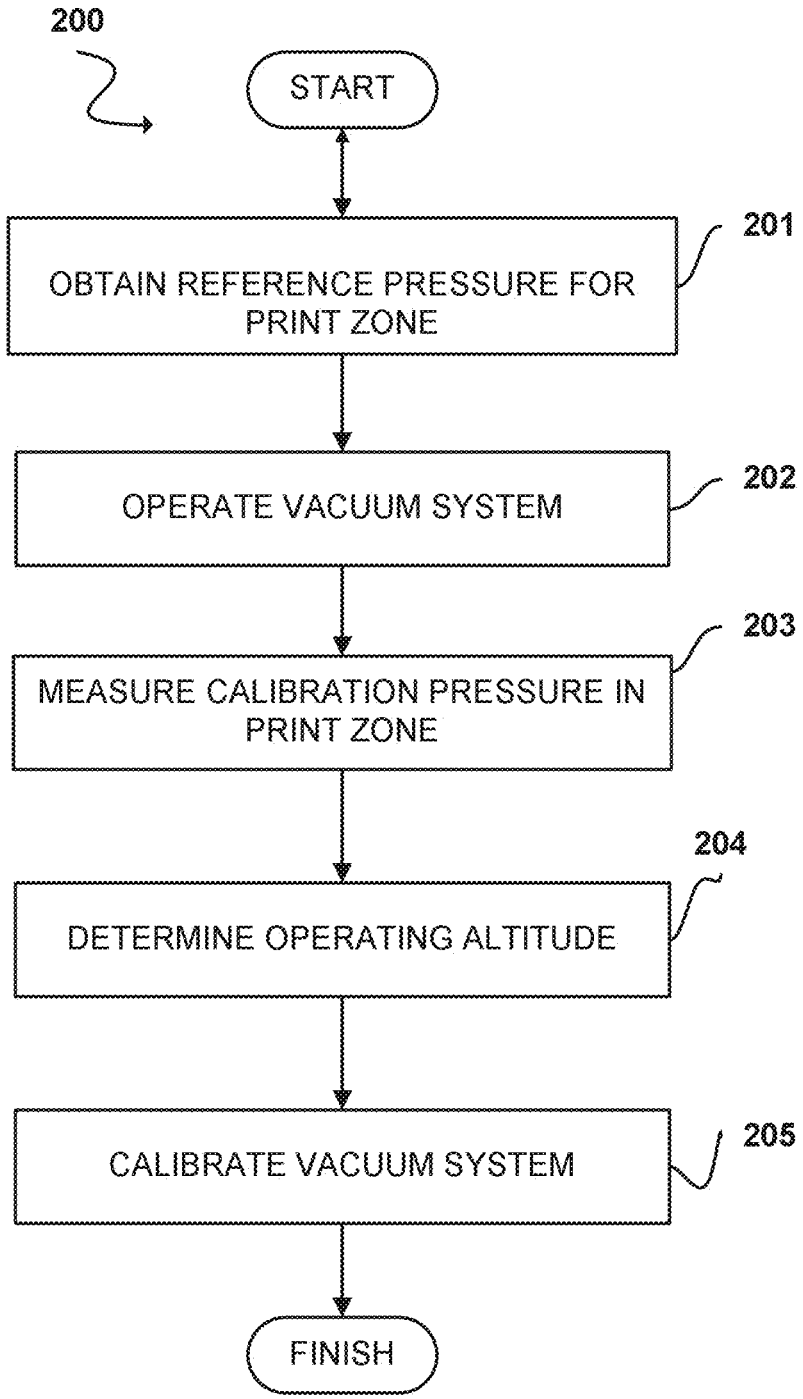
FIG. 2 is a flowchart in accordance with an example of the present disclosure of a method for calibrating a vacuum system in a printing device.

Methods for calibrating a vacuum system in a printing device at a location where the printer is operating is herein disclosed. FIG. 2 illustrates an example method 200 for calibrating a vacuum system that can be performed by the example apparatus of FIG. 1. According to the method 200 of FIG. 2, a reference pressure measurement is obtained 201 by retrieving it from the memory 106. The reference pressure measurement may correspond to the pressure recorded in the print zone 104 when the printing device is at a reference altitude (e.g., at sea level) and whilst the vacuum system 101 was operating in the precalibrated state (e.g., a particular vacuum fan speed). The vacuum system 101 is set to operate 202. A value for the calibration pressure is measured in the print zone 104 by the vacuum sensor 103 at the operating altitude and with the vacuum system 101 in operation 203. Once values for the reference pressure and the calibration pressure have been obtained, the operating altitude can be determined 204 based on the values for the reference pressure and the calibration pressure. The vacuum system 101 may then be calibrated according to the determined altitude 205 to produce a desired level of vacuum at this altitude.

Figure 3:
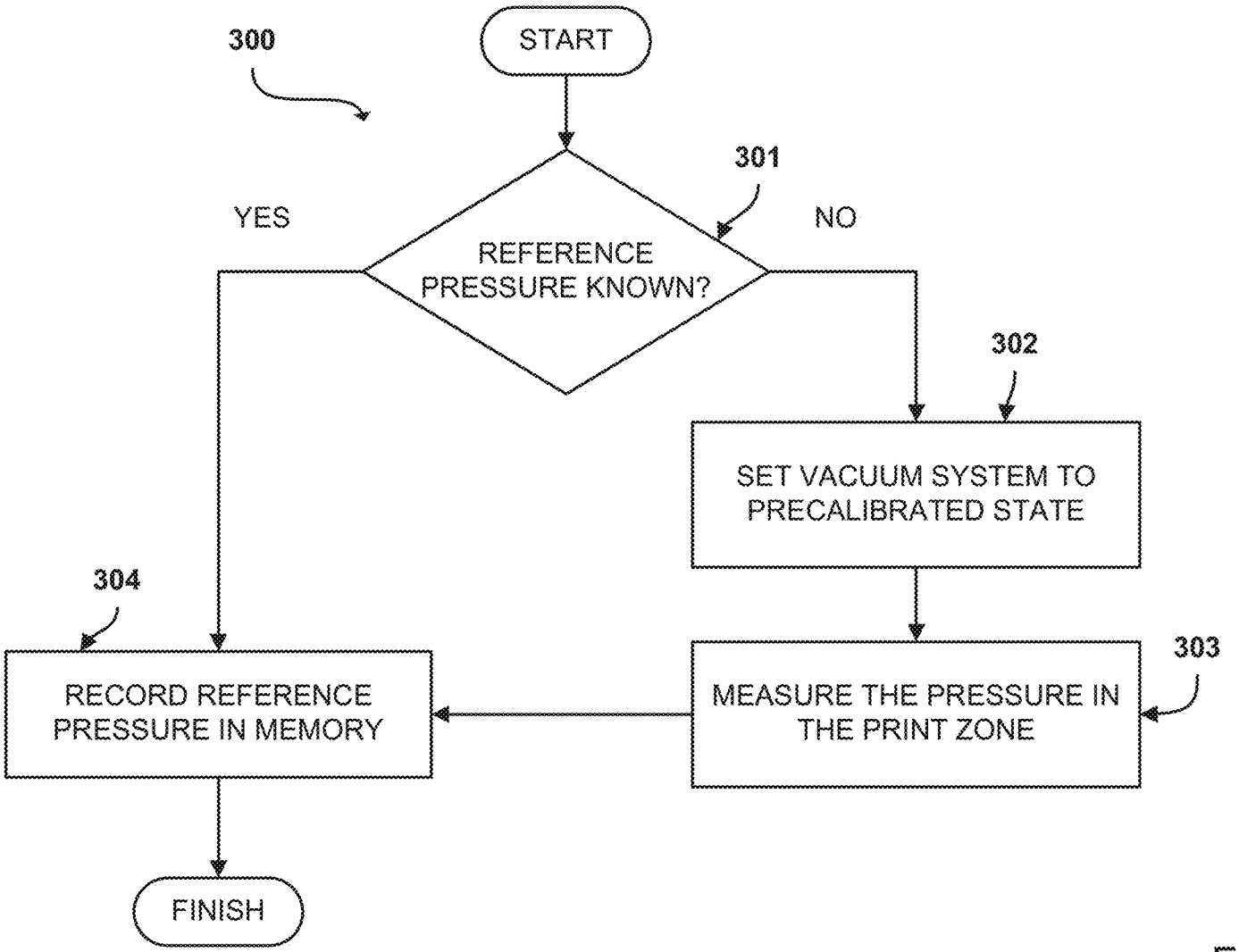
FIG. 3 is a flowchart in accordance with an example of the present disclosure of a method for obtaining the reference pressure for use in calibrating the vacuum system.

Methods for obtaining the reference pressure when the printing device is at a known reference altitude is herein disclosed. FIG. 3 illustrates an example method of obtaining the reference pressure when the printing device is at a known reference altitude that can be performed by the example apparatus of FIG. 1. According to the method of FIG. 3, it is determined whether the reference pressure is known or not known 301. If the reference pressure is known, a value corresponding the reference pressure can be recorded in the memory 106 of the apparatus 304. If the reference pressure is not known, the vacuum system 101 can be set to operate in the precalibrated state 302 and the vacuum sensor 103 can measure the reference pressure in the print zone 303. The measured reference pressure can then be stored in the memory 304 of the apparatus.

In some examples, when the printing device is at an operating location, a vacuum system 101 is initially set to operate in a precalibrated state. A vacuum sensor can be situated in the vacuum manifold 109 and can measure a calibration pressure delivered by the vacuum system in the vacuum manifold 109. A reference pressure, previously measured in the vacuum manifold 109 and stored in the memory, is retrieved. An operating altitude can be determined based on the values of the reference pressure and the calibration pressure in the vacuum manifold 109. The determined altitude can then be used to calibrate the vacuum system 101 accordingly.

In some examples, measuring pressure in the print zone may be performed by measuring pressure in the vacuum manifold coupled to the print zone. In some examples, the pressure sensor may be located remotely from the print zone/vacuum manifold, and the print zone pressure inferred from the remote pressure measurement based on a known relationship.

The example method 300 for obtaining the reference pressure may be performed before the example method for calibrating a vacuum system 101 in a printing device at the location where the printer is operating 200, for example during manufacture, at the manufacturing location. As such, the measurement values corresponding to the reference pressure can be determined prior to installation of the vacuum system 101 in the apparatus 100 or prior to the deployment of the apparatus 100 in a particular operating location.

Figure 4:
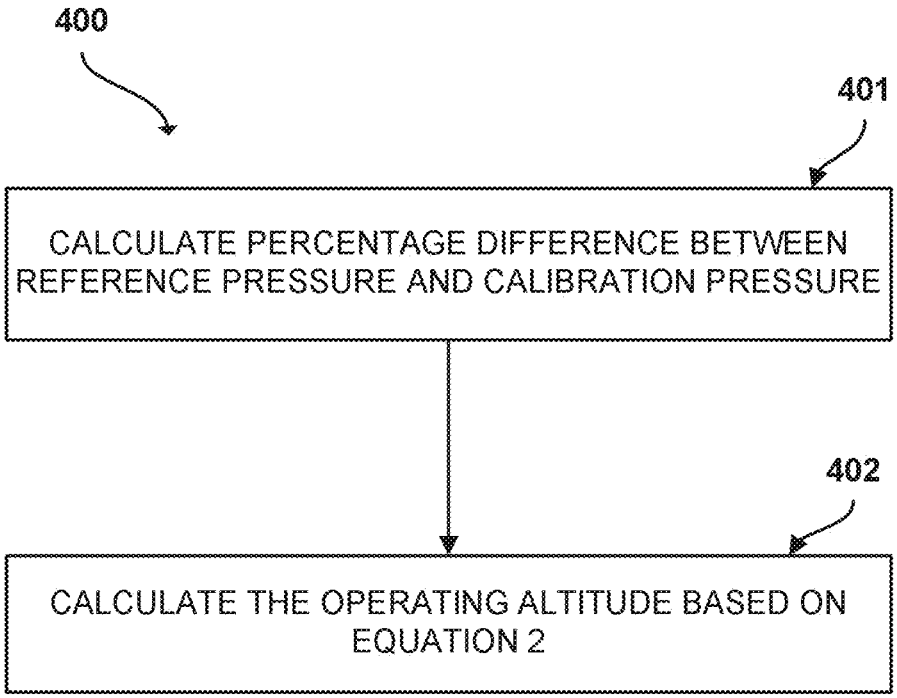
FIG. 4 is a flowchart in accordance with an example of the present disclosure of a method for determining the operating altitude.

Example methods for calculating the operating altitude are herein disclosed. FIG. 4 illustrates an example method 400 of calculating the operating altitude. According to the example method 400 of FIG. 4, the percentage difference between the reference pressure and the calibration pressure may be calculated 401 based on the equation:

$$P_{delta} = \frac{P_{REF} - P_{CAL}}{P_{REF}} \tag{1}$$

wherein, $P_{REF}$ corresponds to the reference pressure and $P_{CAL}$ corresponds to the calibration pressure.

In some example implementations, the altitude, Altitude (m), at the location of operation of the printing device may then be calculated 402 based on the equation:

$$\text{Altitude}(m) = \text{Altitude}_{REF}(m) + \frac{P_{delta} - 0.0065}{1 \times 10^{-4}} \tag{2}$$

wherein $\text{Altitude}_{REF}$ corresponds to a reference altitude where the reference pressure is taken.

The method of FIG. 4 may be performed after measuring the value for the calibration pressure 203 and before calibrating the vacuum system 205.

In some examples, the vacuum system may be recalibrated periodically, for example as part of a power on self test, or whenever the operating location of the printing device changes.

In some examples, calibrating the vacuum system 101 at the location of operation comprises setting or changing the speed of rotation of the vacuum fan, the geometry of a variable geometry fan and/or the arrangement of release valves or any other suitable setting for controlling the vacuum pressure. For example, at higher altitudes, air pressure may be lower, thus, the vacuum fan in the apparatus may rotate faster to create a similar level of vacuum to that at lower altitudes. For example, at an altitude of 2000 m the percentage in pressure drop may be approximately 22%. If the speed of rotation of the vacuum fan 102 remains the same, the vacuum performance may decrease up to 22%. In this case the vacuum fan 102 may rotate faster to compensate for the altitude increase.

The reference altitude may be an altitude at a location for which the value of the altitude is known and a reference altitude value may be stored in the apparatus. The precalibrated state of the vacuum system 101, which produces a desired vacuum in the print zone and corresponds to this reference altitude may also be known and settings corresponding to the precalibrated state may be stored in the memory of the apparatus. For example, the reference altitude may be at sea level. In this example, the reference altitude will be zero meters and equation 2 will reduce to the following:

$$\text{Altitude}(m) = \frac{P_{delta} - 0.0065}{1 \times 10^{-4}} \tag{3}$$

Alternatively, the reference altitude may be at an altitude that is known to a high accuracy and is different from the operating altitude. In this case, equation 2 may be used to find the altitude of the operating location of the printing device from sea level.

In some example implementations, the precalibrated state of the vacuum system can cause the desired operation of the vacuum system when the apparatus is at the reference altitude. For example, the precalibrated state may comprise running the vacuum fan at a predetermined speed of rotation. In the example where the precalibrated state comprises running the vacuum fan at a predetermined speed of rotation and the reference altitude is at sea level, the predetermined speed of rotation may be approximately 9000 rpm.

As mentioned above, the reference pressure may be previously known. In some examples, the disclosed apparatus may have been manufactured as one of a batch, the reference pressure may have been measured by one of the apparatus in the batch of apparatus and the value distributed to the other apparatus in the batch.

In some examples, the printing device, that the disclosed apparatus may be used with, may be an Ink Jet printer. In an Ink Jet printer, a print head is controlled to eject minute droplets of ink from the print head onto a print medium, such as a piece of paper or card. It is desirable that the relative position of the print heads and print medium are precisely maintained to insure high-resolution, high quality printing. This precision may be significant in the "print zone" of an Ink Jet printer. The print zone of an Ink Jet printer is the space where the ink travels from the print head to the print media. The print medium lies on a porous belt; an endless loop secured between a pair of rollers wherein said rollers drive the belt to transport the print medium. A vacuum system is used to apply vacuum pressure via a vacuum manifold to one side of a belt through vacuum ports in a support surface to secure the print medium to it. The vacuum pressure supplied to secure the print medium to the belt may be reduced when the printer is at an altitude higher than the altitude of its manufacture, which may result in the print medium not being adequately secured to the belt and may reduce the quality of the print. Thus, in an Ink Jet printer the vacuum system may be recalibrated to produce a suitable vacuum to hold the print medium against the belt in the printing device at said operating altitude.

In some examples, the printing device may be that of a Large Format Printer (LFP). The altitude where the LFP is working may have a significant impact on printer performance. Furthermore, the correct operation of the vacuum system in an LFP may lead to improved precision of the position of the print medium with respect to the print heads. This improved precision may improve the resolution and printing quality of the LFP.

In some examples, the memory 106 of the apparatus 100 includes be Non-Volatile Memory (NVM) or other non-transient computer readable medium.

Some implementations of the described apparatus may provide an accuracy in altitude of less than 100 m. This improved accuracy may lead to a more desirable vacuum in the print zone and may lead to improved printing quality. Implementations of the described apparatus have shown an accuracy in the altitude of approximately 10% at 1000 m, 3% at 2000 m and 3% at 3000 m.

Some example implementations of the present disclosure avoid the imprecision of a manual entry of altitude during the installation of a printing device.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect or example of the present disclosure are to be understood to be applicable to any other aspect or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The present disclosure is not restricted to the details of any foregoing examples. The present disclosure extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for calibrating a vacuum system in a printing device comprising:

obtaining a reference pressure value for a print zone of the printing device, wherein the reference pressure value is a vacuum pressure generated in the print zone by the vacuum system while operating at a reference altitude;

measuring a calibration pressure value in the print zone of the printing device when the printing device is at an operating location, wherein the calibration pressure value is the vacuum pressure generated in the print zone by the vacuum system while operating at the operating location;

determining an altitude based on the reference pressure value and the calibration pressure value; and applying an operating setting to the vacuum system based on the determined altitude.

2. The method of claim 1, wherein measuring the calibration pressure value further comprises operating the vacuum system in a precalibrated state.

3. The method of claim 1, wherein the vacuum system comprises a vacuum fan and wherein applying the operating setting to the vacuum system comprises setting or changing the speed of rotation of the vacuum fan.

4. The method of claim 1, wherein the reference pressure value or the calibration pressure value is stored in a Non-Volatile Memory.

5. The method of claim 1, wherein determining the altitude based on the reference pressure value and the calibration pressure value comprises calculating a percentage difference between the reference pressure value and the calibration pressure value.

6. The method of claim 5, wherein determining the altitude comprises calculating the altitude based on the percentage difference and the reference altitude.

7. The method of claim 1, wherein obtaining the reference pressure value further comprises retrieving the reference pressure from a memory wherein the reference pressure value was recorded during manufacture.

8. The method of claim 7, wherein the reference pressure value to be stored in the memory is obtained by measuring the pressure in the print zone at the reference altitude when the vacuum system is operating in a precalibrated state.

9. The method of claim 1, wherein the reference altitude is at sea level.

10. An apparatus for use in a printing device comprising:

a vacuum system coupled to a print zone of the printing device comprising:

a vacuum sensor to measure pressure in the print zone of the printing device;

a processor; and a memory comprising program code that, when executed on the processor, performs the operations of:

obtaining a reference pressure value, wherein the reference pressure value is a vacuum pressure generated in the print zone by the vacuum system while operating at a reference altitude;

measuring a calibration pressure value in the print zone of the printing device using the vacuum sensor, wherein the calibration pressure value is the vacuum pressure generated in the print zone by the vacuum system when the printing device is at an operating location and the vacuum system is in operation;

determining an altitude of a printing device based on the reference pressure value and the calibration pressure value; and applying an operating setting to the vacuum system based on the determined altitude.

11. The apparatus of claim 10, wherein the vacuum system further comprises a vacuum fan, wherein the program code is further to change the speed of rotation of the vacuum fan based on the determined altitude.

12. The apparatus of claim 10, wherein the memory is to store at least one of the reference pressure value and the calibration pressure value.

13. The apparatus of claim 10, wherein the vacuum system further comprises a vacuum manifold coupled to the print zone and wherein the vacuum sensor is arranged to measure the pressure in the vacuum manifold.

14. The apparatus of claim 10, wherein the memory is to store the reference pressure value, the reference pressure corresponding to the pressure in the print zone at a reference altitude and when the vacuum system is operating in the precalibrated state.

15. The apparatus of claim 10, wherein the reference altitude is at sea level.

16. A method for calibrating a vacuum system in a printing device comprising:

obtaining a reference pressure value for a print zone of the printing device wherein the reference pressure value is a vacuum pressure generated in the print zone by the vacuum system while operating at a reference altitude;

measuring a calibration pressure value in the print zone of the printing device when the printing device is at an operating location, wherein the calibration pressure value is the vacuum pressure generated in the print zone by the vacuum system while operating at the operating location;

determining an altitude at the operating location based on the reference pressure value and the calibration pressure value; and calibrating the vacuum system based on the altitude to produce a desired level of vacuum.

17. The method of claim 16, wherein calibrating the vacuum system comprises determining an operating setting of the vacuum system based on the altitude.

18. The method of claim 17, wherein determining the altitude where the printing device is operating comprises calculating a percentage difference between the reference pressure value and the calibration pressure value.

19. The method of claim 16, wherein measuring the calibration pressure value further comprises operating the vacuum system in a precalibrated state.

20. The method of claim 16, wherein the vacuum system comprises a vacuum fan and wherein calibrating the vacuum system comprises applying an operating setting to the vacuum system to set or change the speed of rotation of the vacuum fan.

* * * * *